United States Patent [19]

Masygan

[11] 3,938,171

[45] Feb. 10, 1976

[54] PHOTOGRAPHIC DEVELOPER APPARATUS

[75] Inventor: Raymond Joseph Masygan, Burlington, Canada

[73] Assignee: Alex E. Clark Limited, Islington, Canada

[22] Filed: Nov. 20, 1973

[21] Appl. No.: 417,523

Related U.S. Application Data

[62] Division of Ser. No. 80,836, Oct. 15, 1970, abandoned.

[52] U.S. Cl. ..... 354/299; 354/312; 354/314; 354/329; 354/331; 354/341; 354/345

[51] Int. Cl.[2] ..... 603D 13/00

[58] Field of Search ..... 354/297, 299, 307, 311, 354/312, 313, 314, 324, 329, 330, 331, 332, 336, 341

[56] References Cited

UNITED STATES PATENTS

| | | | |
|---|---|---|---|
| 1,363,117 | 12/1920 | Hoff | 354/329 X |
| 2,119,230 | 5/1938 | Hagen | 354/329 X |
| 2,238,661 | 4/1941 | Shaeffer | 354/331 X |
| 2,285,019 | 6/1942 | DeYette | 354/312 |
| 3,626,834 | 12/1971 | Speranza | 354/299 |
| 3,698,307 | 10/1972 | Reichardt | 354/312 |

*Primary Examiner*—Richard M. Sheer
*Attorney, Agent, or Firm*—Shlesinger, Arkwright, Garvey & Dinsmore

[57] ABSTRACT

A method and apparatus for processing photographic sheet material, in which the edge of the sheet is attached to a rod having an aerofoil cross-section. Upon passing the rod through processing liquid the liquid flows over the leading edge of the rod and produces turbulence on the face of the sheet which is lying in the plane of the aerofoil. In a reel comprising spaced rods the sheets may overlap and the turbulence will keep them separated. Sheet film may be attached at opposed edges to such rods placed back-to-back. Inner and outer concentric reels may be used, and such reels may carry roll film. A trough for use with developer reels has a longitudinal slot for rapid drainage. In another embodiment a closed tank having an air inlet and a longitudinal air outlet slot controls ambient conditions. In a further embodiment a pair of slotted end discs carry photographic sheet material without supporting rods.

2 Claims, 19 Drawing Figures

PHOTOGRAPHIC DEVELOPER APPARATUS

This application is a division of application Ser. No. 80,836, filed Oct. 15, 1970 in the name of Raymond Joseph Masygan, assignor to Alex Clark Limited, now abandoned.

The present invention relates to the processing of photographic sheet material and roll film.

A current method of processing photographic sheet material on an emulsion carrier is to fasten one or more individual sheets to a horizontally disposed drum and rotate the drum to pass the sheets sequentially through a pool of chemical solution located below the reel axis. For improved operation and increased carrying capacity, the drum may have curved blades supporting attached sheets, for instance as shown in U.S. Pat. No. 3,359,880 issued Dec. 26, 1967 to H. Huss. However, such reels are relatively complicated in structure and are expensive to fabricate if breakage is to be prevented.

The present invention overcomes this disadvantage by providing a rod of aerofoil cross-section which carries only one edge of a sheet of photographic material, and a reel comprising a cylindrical arrangement of such rods.

For the processing of sheet film, which is less flexible than paper, the invention provides a reel having, formed integrally, such rods placed back-to-back.

In developing roll film a reel of the squirrel-cage type is usually used, having a row of parallel bars or rods equally spaced about the circumference of the reel to form the cylindrical periphery. Such reels are inadequate because they accommodate only a short length of roll film for development in one step.

The present invention overcomes this disadvantage by providing a reel having concentric rows of rods to accomodate nearly twice the length of roll film for development in a single operation.

When processing photographic sheet material or film it is also desirable to remove the liquid processing chemical as quickly and uniformly as possible and in another aspect the invention provides a trough adapted to accommodate a horizontally disposed reel and having a longitudinal slot in its lowermost portion with a releasable seal.

For certain purposes the use of open troughs in the processing of photographic sheet material or film is not adequate to give a product of sufficiently high standard and the present invention further provides a closed tank of improved construction for controlling ambient conditions about a reel.

Finally, the invention provides a further simplified reel in which sheet retaining rods are eliminated and slotted end discs alone retain the photographic sheet material or film on the reel.

Example embodiments of the invention are shown in the accompanying drawings, in which.

Figure 1:
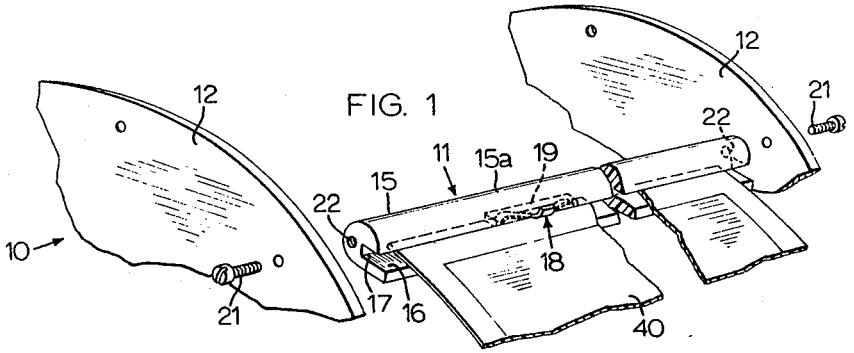
FIG. 1 is a fragmentary, exploded perspective view of a retaining rod and a reel according to the invention.
Figure 2:
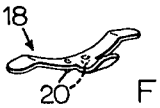
FIG. 2 is a perspective view of a retaining clip used in the rod of FIG. 1.

The embodiment of the invention shown in FIGS. 1 to 4 of the drawings consists of a reel 10 constructed of a plurality of bars or rods 11 interconnecting a pair of circular discs or end caps 12. Rods 11 are located in parallel, evenly spaced relationship one from another to provide, with end caps 12, a reel of cylindrical squirrel-cage construction. A central hollow shaft 13 extends through end caps 12 along the longitudinal axis of reel 10.

Each rod 11 is formed to have an arcuate leading edge 15 with its lower end merging into a trailing lip or flange 16 and its upper end curving back downwardly to meet the trailing flange, forming a shoulder **15*a*. A slot 17, located in the plane of rod 11 between shoulder 15*a* and flange 16, extends the length of the rod and is wide enough to loosely receive a sheet of photographic material. At least one wing-shaped retaining clip 18 is located intermediate the ends of rod 11 in a recess 19 of shoulder 15*a* of the rod and is urged by the spring action of its wings against flange 16 within slot 17, with two domes 20 protruding from the clip and actually bearing against the flange. Rods 11 are fastened at each end to caps 12 by screws 21 engaging holes 22** one in each end of each rod.

Figure 3:
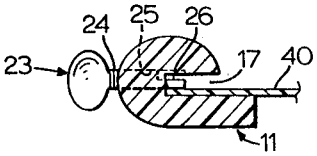
FIG. 3 is a cross-sectional view of the rod of FIG. 1 showing an alternate form of retaining device.

An alternate retaining device on rod 11 is shown in FIG. 3 and consists of at least one thumb screw 23 having a threaded shaft 24 engaged in a transverse bore 25 in rod 11 opening into slot 17. The free end of shaft 24 screw 23 caries a notch 26 making the screw shaft hemispherical in cross-section.

Figure 4:
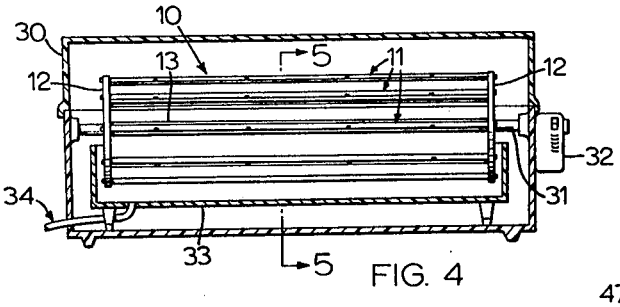
FIG. 4 is a side view of the reel of FIG. 1, mounted in a developing tank shown in cross-section.

As shown in FIG. 4 of the drawings, reel 10 is mounted for use in a tank 30 having a drive shaft 31 journalled within it and suitably driven, for instance by an electric motor 32 mounted on the tank. Reel 10 is mounted within tank 30 on drive shaft 31 (which passes through hollow shaft 13) and is keyed to rotate with the drive shaft. An arcuate trough 33 is mounted in tank 30 and positioned below reel 10 in a manner to locate the lower portion of the mounted reel within the trough.

Suitable liquid input and drainage means (generally indicated by numeral 34) are provided for trough 33.

The components of reel 10 may be formed of any suitable, noncorrosive material. Rods 11 and end caps 12 are preferably formed of nylon by extrusion, while shaft 13, clip 18 and screws 21 are preferably made of stainless steel.

Figure 5:
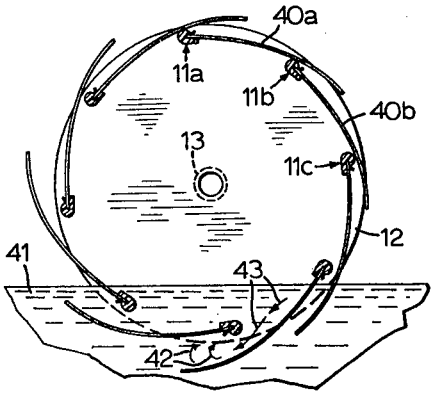
FIG. 5 is a cross-section taken along the line 5—5 of FIG. 3.

In the operation of the device, one edge of a sheet 40*a* of photographic material is inserted into slot 17 of roll 11*a* beneath grips 20 of clip 18 or thumb screw 23, face upward, and overlies the next succeeding rod 11*b*, as shown in FIG. 5, the sheet being held in the slot by the action of the clip against flange 16 or by turning the thumb screw. The next sheet 40*b* of photographic material is then inserted into slot 17 of the next succeeding rod 11*b* in the same manner, sheet 40*b* underlying sheet 40*a* and overlying the next rod 11*c*. In this manner the whole of reel 10 may be loaded. The loaded reel is mounted on shaft 31 in tank 30 as seen in FIG. 4, bowl 33 is filled with chemical processing liquid 41 at least to a depth to cover the lowermost of rods 11, and the reel is rotated in a direction whereby leading edge 15 of each rod moves forwardly through the liquid. This sets up a turbulence in the liquid flowing over the leading edge of the rod, in the manner of air flowing over an aircraft wing, as shown generally by arrows 42, which increases the efficiency of the chemical action on the photographic material. Also, the liquid accelerates as it passes over the leading edge 15 of rod 11, again as in an aerofoil and as shown generally by arrows 43, and this accelerating liquid impinges on the back of the overlying sheet which acts to separate the two sheets and allows full access of liquid across the underlying sheet for proper processing.

It will be seen that by the present invention an increased number of sheets of photographic material may be accommodated on a reel by overlapping them to a great extent, without the need for structural means to keep the sheets separated.

Figure 6:
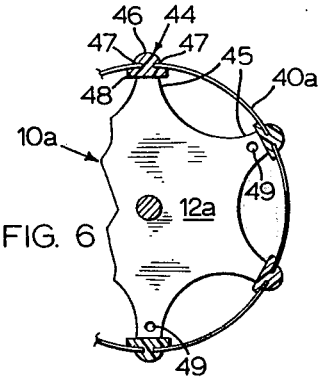
FIG. 6 is a view, similar to FIG. 4, showing an alternate construction of the reel of FIG. 3 for use with film.
Figure 7:
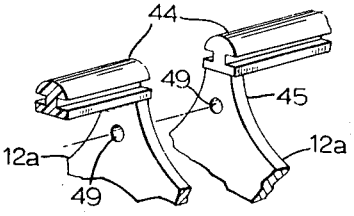
FIG. 7 is a fragmentary view in perspective showing the joining of a pair of reels of FIG. 6.

In the alternate embodiment shown in FIGS. 6 and 7 of the drawings a rod 44 replaces each rod 11 of the previous embodiment and is fixed to a spoke 45 radiating from end cap 12*a* of a reel 10*a*. Rod 44 is the equivalent of two of rods 11 of the previous embodiment, placed back to back, and comprises a laterally concave dome 46 running the length of the rod and overlying a pair of opposed slots 47 also running the length of the rod above a trailing lip or flange 48. As seen in FIG. 7, rods 44 are fixed against the outer end of spokes 45 to form a flat face and spokes 45 carry apertures 49 allowing pairs of reels 10*a* to be bolted together.

Figure 8:
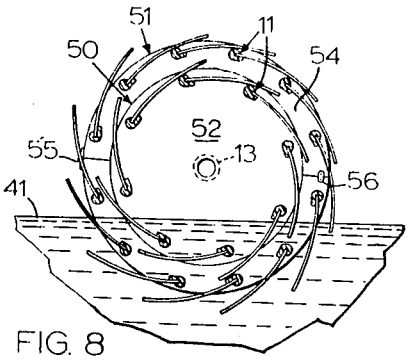
FIG. 8 is a cross-sectional view, similar to FIG. 4, of a further alternate embodiment of the reel of FIG. 1.
Figure 9:
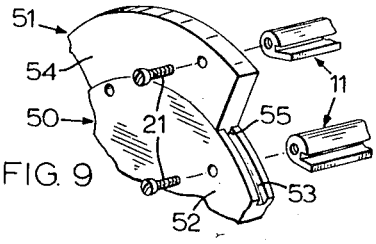
FIG. 9 is a fragmentary exploded perspective view of the reel of FIG. 8.

In a further alternate embodiment of the invention shown in FIGS. 8 and 9 of the drawings a reel of the type shown in FIGS. 1 to 5 is employed but with a double row of rods 11 forming concentric inner and outer cylinders 50 and 51 respectively. Inner cylinder 50 has a pair of end caps 52 each with a circumferential groove 53 while outer cylinder 51 has a pair of end rings 54 each with an inwardly projecting circumferential tongue 55 adapted to be engaged in groove 53. End rings 54 are each split in two halves and the halves are connected with a hinge 55 and a releasable fastener 56.

In the operation of the reel shown in FIGS. 8 and 9, outer cylinder 51 is separated from inner cylinder 50 by unlocking fastener 56 and separating the two halves of the cylinder. Rods 11 of inner cylinder 50 are then loaded with photographic sheet material 40 as described in the previous embodiment. Outer cylinder 51 is replaced and fastened onto loaded inner cylinder 50 and rods 11 of the outer cylinder are loaded with sheets 40 in the same manner. The reel is then mounted in tank 30 and chemical processing liquid is poured into trough 33 to form a pool 41 having a level covering the lowermost of rods 11 in both cylinders 50 and 51. Processing then proceeds as before.

It will be appreciated that the reel of FIGS. 8 and 9 allows more sheets of photographic material to be processed in a single operation without a proportional increase in the amount of liquid chemical used.

Figure 10:
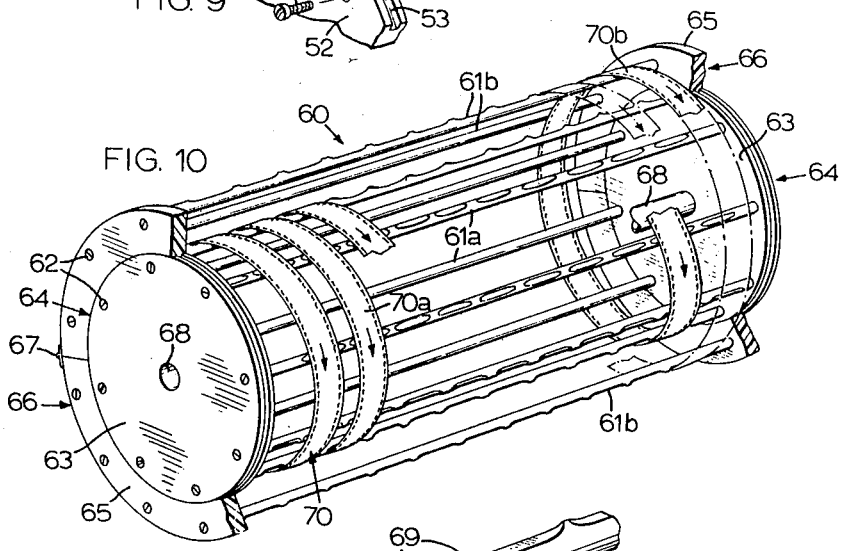
FIG. 10 is a perspective view, partly broken away, of a further reel of the invention.
Figure 11:
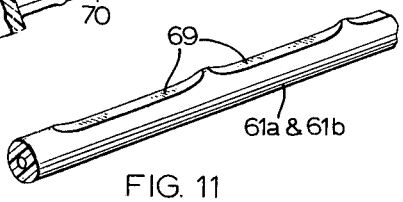
FIG. 11 is a perspective view of a rod used in the embodiment of FIG. 10.

The further embodiment of the invention shown in FIGS. 10 and 11 of the drawings consists of a reel 60 having a plurality of rods 61*a* fixed in parallel, spaced relationship by screws 62 to a pair of end hubs 63 to form an inner cylinder 64 of squirrel-cage configuration, and a further plurality of rods 61*b* fixed in parallel, spaced relationship by screws 62 to a pair of end rings 65 to form an outer cylinder 66 also of squirrel-cage configuration and concentric with inner cylinder 64. As in the embodiment of FIGS. 8 and 9, each end ring 65 is divided along its diameter with a hinge 67 joining one end of the two halves and a releasable latch (not shown) joining the other end whereby the ring is held on hub 63 by means of a tongue-and-groove arrangement as before. A hollow axial shaft 68 joins hubs 63.

Each rod 61 is scalloped as shown in FIG. 11 to form a series of shallow depressions 69 along the rod. Depressions 69 are of a length to accommodate a width of roll film and are offset in adjacent rods to provide a spiral path proceeding in one direction along inner cylinder 64 and in the opposite direction along outer cylinder 66.

To load reel 60, outer cylinder 66 is removed (as described in FIG. 8), the end of a length of roll film 70 is suitably attached (preferably by a releasable clip) to a rod 61*a* at one end of the rod, and film 70 is then wound spirally around inner cylinder 64, as indicated by numeral 70*a*, until the opposite end of the cylinder is reached. Outer cylinder 66 is then reattached to cylinder 64 (as described before) and film 70 is extended from rods 61*a* to rods 61*b* and continues to be wound spirally on outer cylinder 66, but in a direction opposite to the winding on inner cylinder 64, as indicated by numeral 70*b*, until the end of the film is reached whereupon it is clipped to one of rods 61*b* in known manner. It will be seen that by this construction a roll film of increased length may be accommodated on a reel and processed in a single operation.

Figure 12:
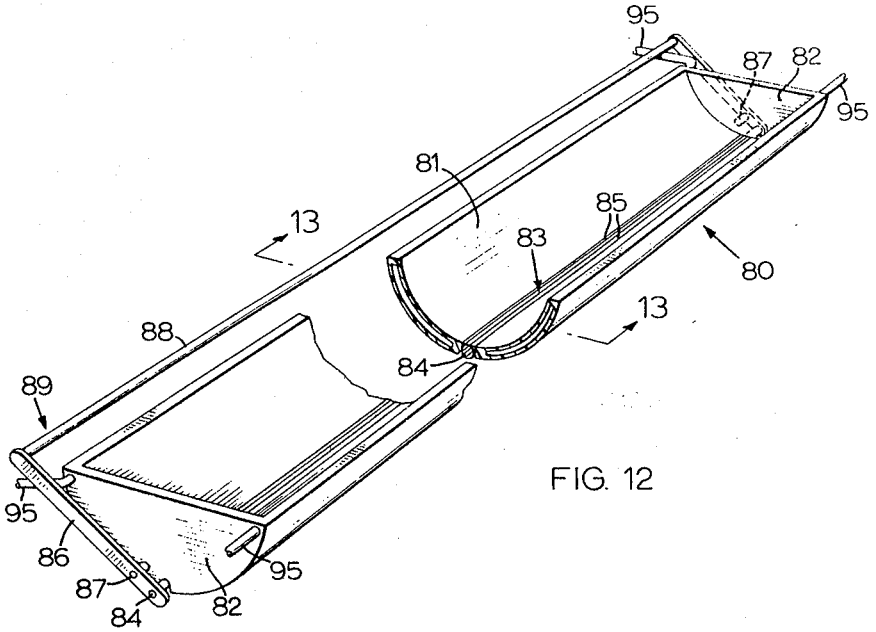
FIG. 12 is a perspective view, partly broken away, showing an alternate embodiment of a trough of the invention.
Figure 13:
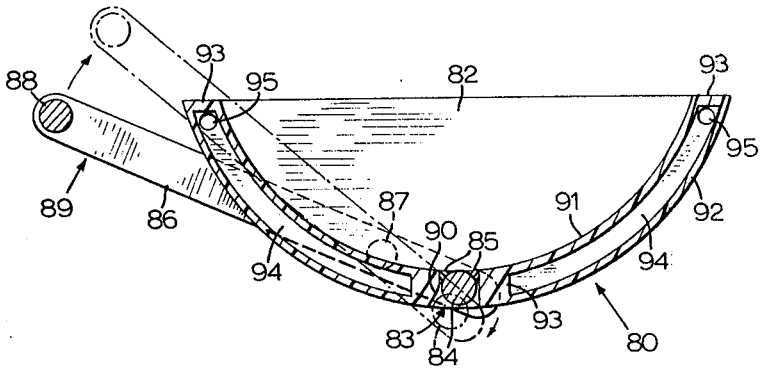
FIG. 13 is a view in cross-section of the trough taken along the line 13—13 of FIG. 9.

The embodiment shown in FIGS. 12 and 13 of the drawings consists of a fixed trough 80 having an arcuate longitudinal wall 81 terminating in a pair of spaced end walls 82. Located longitudinally within wall 81 in its lowermost portion is an aperture or slot 83 which extends the length of trough 80 between end walls 82. A stopper rod 84 is adapted to fit freely into slot 83 against a pair of wedge gasket strips 85 fixed one on either side of the slot and coextensive with its length. Rod 84 may be chamfered along its upwardly facing portion to provide a smooth inner surface of wall 81 where the rod seals slot 83.

Rod 84 extends beyond each end wall 82 of trough 80 and is fixed at each end transversely to one end of a bar 86 which is pivoted intermediate its ends about a fulcrum pin 87 mounted on end wall 82. The end of bar 86 remote from rod 84 carries a second fixed rod 88 to form a rigid pivotable frame 89 carrying stopper rod 84. The edge of slot 83 closer to fulcrum pin 87 may have a chamfered lower portion 90 to provide clearance for stopper rod 84.

In the operation of this embodiment suitable means are provided (for example a foot pedal linked with frame 89) for pivoting frame 89 about pins 87 to move stopper rod 84 into slot 83 and against gaskets 85 to seal the slot and hold liquid processing chemical within trough 80, and to move the stopper rod out of the slot to open the slot and drain away the liquid chemical quickly by downward flow.

Wall 81 of trough 80 may be constructed of an inner shell 91 and an outer shell 92, with edge seals 93, to provide a pair of intermediate chambers 94. Pairs of conduits 95 leading into chambers 94 allow suitable liquid to be circulated within the chambers for temperature control of the liquid processing chemical forming a pool within trough 80.

Figure 14:
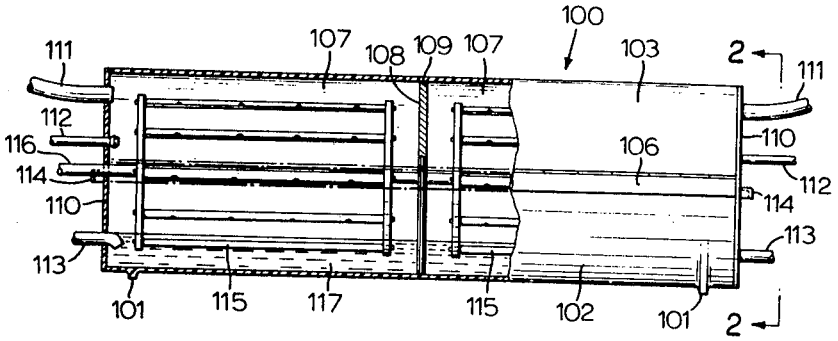
FIG. 14 is a side view, partly broken away, showing an alternate embodiment of a developing tank.
Figure 15:
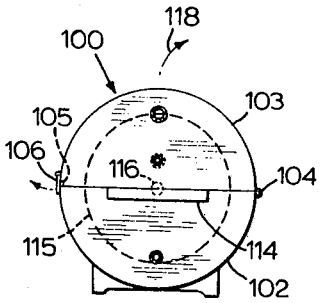
FIG. 15 is an end view of the tank taken along the line 15—15 of FIG. 14.

FIGS. 14 and 15 of the drawings show a developing tank 100 which is cylindrical and rests, with its axis horizontal, on a pair of feet 101. Tank 100 is divided horizontally into a lower section 102 and an upper section 103 attached longitudinally by a hinge 104 to the lower section. A recess runs the length of upper section 103 at its junction with lower section 102 to form a slot 105 which is covered by a flap 106 freely hinged to the upper section. The interior of tank 100 is divided into two compartments 107 by a disc divider 108 having a circumferential gasket 109 which provides a seal between the two compartments 107 when tank 100 is closed. Compartments 107 are fed separately through end walls 110 of tank 100, each by a flexible air hose 111 opening into wall 110 in its upper portion, a water spray nozzle 112 also projecting through the upper portion of wall 110, and a chemical inlet conduit 113 projecting into the lower portion of the tank through the end wall. A tilt holding bracket 114 is fixed to the outside of the upper portion of each end wall 110. Within each compartment 107 of tank 100 a reel 115, such as the reel shown in FIGS. 1 to 5, is loosely keyed on a coaxial drive shaft 116 which is journally mounted in, and axially removable from, disc 108 and end walls 110, and is driven by suitable means (not shown).

In the operation of the device of FIG. 14 and 15, reels 115 are loaded with photographic paper to be processed and are mounted within tank 100 on shaft 116. Tank 100 is then closed and a predetermined quantity of chemical processing liquid is introduced into each compartment 107 through inlet conduit 113 to lie in a pool 117 in the lower portion of the compartment. Reels 115 are then rotated by shaft 116 while air at a controlled temperature is introduced into compartments 107 through hoses 111 and escapes from tank 100 through slot 105. When the photographic paper has been processed, upper section 103 of tank 100 is opened about hinge 104 in the direction of arrow 118 and reels 115 are removed by withdrawing shaft 116 out of the tank to disengage the reels, after which upper section 103 is re-closed. Tank 100 is then tilted by brackets 114 to drain pool 117 through slot 105, after which water is introduced into the tank through spray nozzles 112 to wash away any residual liquid chemical and is similarly removed from the tank. Of course the device of FIGS. 12 and 13 could be adapted for use with tank 100 to provide a drain for the removal of liquid chemical and water instead of tilting the tank.

With reels 115 rotating in an open tank, the air would tend to cool the photographic paper being processed.

Closed tank 100 enables the processing temperature to be controlled and improves the quality of the product. Also, photographic film sheets can be mounted on reels 115 since their free ends bear against the cylindrical wall of tank 100 which prevents flapping of the sheets against pool 117 and consequent streaking.

Figure 16:
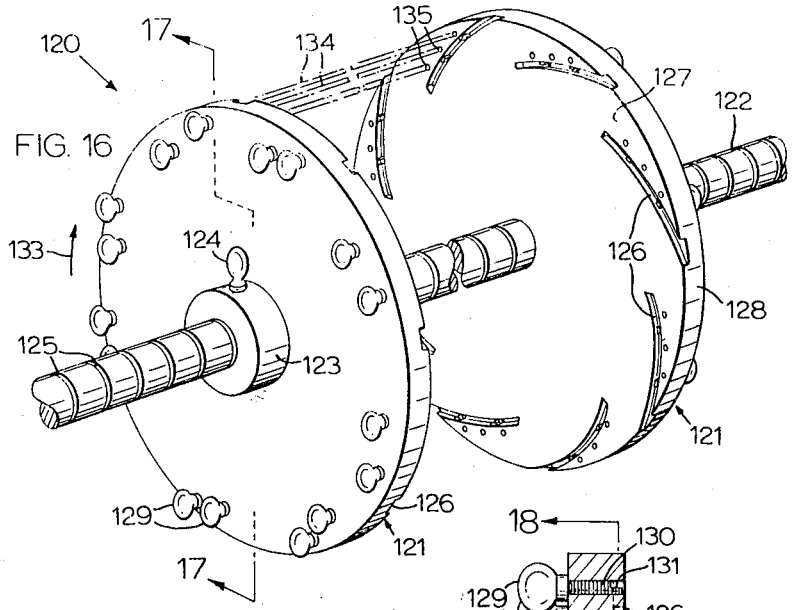
FIG. 16 is a perspective view of another reel of the invention.

The embodiment shown in FIGS. 16 to 19 of the drawings consists of a reel 120 having a pair of retainer discs 121 slidably mounted on an axial shaft 122. Each disc 121 has a boss 123 carrying a threaded thumb screw 124 which engages any one of a series of circumferential notches 125 spaced along shaft 122 to key the disc to the shaft. A plurality of channels or slots 126 are located on the inner face 127 of each disc 121, i.e. on opposed faces. Slots 126 are spaced around the peripheral portion of each disc 121 and curve inwardly from rim 128 of the disc in a truncated convolute path of predetermined length, as seen in FIG. 16. A pair of thumb screws 129, having threaded shafts 130 notched to provide hemispherical free ends 131 are mounted on discs 121 to project into each slot 126.

Figure 18:
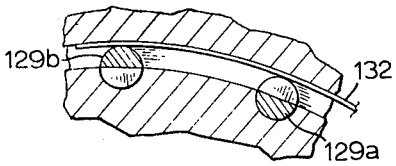
FIG. 18 is a cross-sectional view taken along the line 18—18 of FIG. 17.

In the operation of reel 120 of FIGS. 16 to 19, thumb screws 129 are turned to clear notched ends 131 from slots 126 as indicated by screw **129*a* in FIG. 18, and discs 121 are turned on shaft 122 until slots 126 on the discs are in direct opposition one to another. Also, discs 121 are adjusted along shaft 122 to accommodate a given sheet width of photographic material and notches 125 are graduated for this purpose. Sheets 132 of photographic material to be processed are then mounted on reel 120 by slipping the lateral edges of each sheet along a pair of opposed slots 126. By turning screws 129 move notched ends 131 into slots 126 as indicated by screw 129b in FIG. 18, the edge of sheet 132 is wedged between the screw end and the wall of the slot. When sheets 132 are secured in this manner they form vanes and by rotating reel 120 in the direction of arrow 133 liquid chemical will pass over the sheets acting as scoops. For processing longer sheets of photographic material with reel 120, a plurality of bars 134 may be inserted between holes 135 in opposing discs 120** to reinforce the back of the sheets and prevent sagging.

Figure 19:
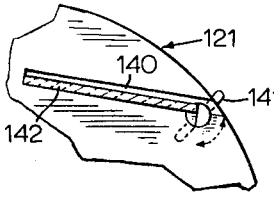
FIG. 19 is a side view showing an alternate construction of the end caps of the reel of FIG. 16.
Figure 17:
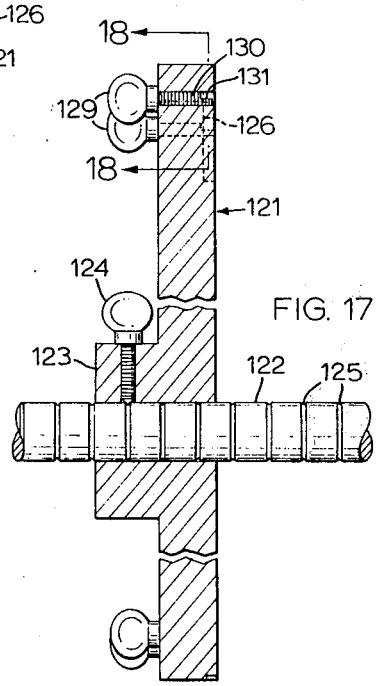
FIG. 17 is a cross-sectional view taken along the line 17—17 of FIG. 16.

For glass photographic plates the modification shown in FIG. 19 may be used on reel 120. In this embodiment straight slots 140 are located in discs 121 and a single thumb screw 141 is used to block the exit of a plate 142 located in the slot.

I claim:

1. A tank, for processing sheets of photographic material or film mounted circumferentially on a reel rotatably mountable in the tank, comprising:

a horizontally oriented closed tubular cylinder having a cylindrical wall defining a chamber, the cylinder being divided into an upper section and a lower section, the upper section being hinged to the lower section and openable for access to the chamber;

means to feed air into the upper portion of the chamber;

means to feed liquid into the lower portion of the chamber;

the wall of the cylinder being interrupted in the area of the junction between the upper and lower sections thereof to define a longitudinal slot, a flap being freely hinged on the wall and covering the slot, whereby air in the chamber may pass out therefrom through the slot and liquid in the lower portion of the chamber may, on rotating the cylinder on the longitudinal axis thereof, pass out from the chamber through the slot.

2. A tank as claimed in claim 1 in which a recess is located in the upper section of the cylinder at its junction with the lower section to form said slot, the flap being freely hinged on the upper section.

* * * * *